US005265848A

United States Patent [19]

Michaud et al.

[11] Patent Number: 5,265,848

[45] Date of Patent: Nov. 30, 1993

[54] FOLDING PORTABLE PLAY ENCLOSURE FOR CHILDREN

[75] Inventors: Marquerite Michaud; Elizabeth Lee-Baker, both of Calgary, Canada

[73] Assignee: Hi Five Promotions, Ltd., Canada

[21] Appl. No.: 938,941

[22] Filed: Sep. 1, 1992

[51] Int. Cl.[5] ..... A64H 33/00

[52] U.S. Cl. ..... 256/26; 256/24; 446/478

[58] Field of Search ..... 256/25, 26; 446/478, 446/476, 487, 488

[56] References Cited

U.S. PATENT DOCUMENTS

| | | | |
|---|---|---|---|
| 1,881,356 | 10/1932 | Gold . | |
| 1,982,433 | 11/1934 | Hungerfold . | |
| 2,608,026 | 8/1952 | Bland . | |
| 3,498,587 | 3/1970 | Friedberg . | |
| 3,548,552 | 12/1970 | McBride . | |
| 3,627,272 | 12/1971 | Friedberg | 256/25 |
| 3,654,645 | 4/1972 | Lee . | |
| 3,722,009 | 3/1973 | Hrynda . | |
| 4,696,652 | 9/1987 | Reeder et al. . | |
| 4,838,525 | 6/1989 | Snow | 256/26 |
| 4,883,443 | 11/1989 | Chase . | |
| 4,932,172 | 6/1990 | Mass . | |

*Primary Examiner*—Randolph A. Reese
*Assistant Examiner*—Anthony Knight
*Attorney, Agent, or Firm*—Jerry T. Kearns

[57] ABSTRACT

A folding portable play enclosure for children includes a plurality of panels connected in a series in an accordion-fold manner by a plurality of folding joints. The panels are formed by cardboard sheets sandwiched between inner and outer flexible vinyl layers. The folding joints are formed by the provision of spaces between the ends of each adjacent pair of cardboard sheets in the series. First indicia on one face of each of the panels simulates an exterior appearance of a home and includes trees, exterior windows, exterior doors, and fences, for example. Second indicia on an opposite face of the panels simulates an interior appearance of a home and includes furniture, interior windows, interior doors, and bookshelves, for example. Cooperating snap fasteners allow the enclosure to be selectively secured in an erected orientation forming a closed play space or in a compact collapsed orientation for transportation and storage. A handle provided on one of the panels allows the enclosure to be conveniently carried in the collapsed orientation.

20 Claims, 2 Drawing Sheets

FOLDING PORTABLE PLAY ENCLOSURE FOR CHILDREN

BACKGROUND OF THE INVENTION

The present invention relates to play enclosures for children, and more particularly relates to a foldable collapsible play enclosure designed to occupy a minimum of space in a collapsed orientation while still affording an interesting play environment for children.

Various types of doll houses and the like have been proposed in the prior art. However, such prior art toy and doll houses are typically very small and have very limited access to the interior. Accordingly, these prior art type doll houses do not allow children entry into the doll house environment in order to effect a realistic home simulation. Additionally, the prior art type doll houses and other similar articles are typically rather intricate and difficult to assemble. Thus, the prior art toy houses are generally not suitable for use by young children.

SUMMARY OF THE INVENTION

Accordingly, it is an object of the present invention to provide a new and improved folding portable play enclosure for children which includes a plurality of panels connected in a series in an accordion-fold manner by a plurality of folding joints. The panels are formed by cardboard sheets sandwiched between inner and outer flexible vinyl layers. The folding joints are formed by the provision of spaces between the ends of each adjacent pair of cardboard sheets in the series. First indicia on one face of each of the panels simulates an exterior appearance of a home and includes trees, exterior windows, exterior doors, and fence sections, for example. Second indicia on an opposite face of the panels simulates an interior appearance of a home and includes furniture, interior windows, interior doors, and bookshelves, for example. Cooperating snap fasteners allow the enclosure to be selectively secured in an erected orientation forming a closed play space or in a compact collapsed orientation for transportation and storage. A handle provided on one of the panels allows the enclosure to be conveniently carried in the collapsed orientation.

These and various other advantages and features of novelty which characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described preferred embodiments of the invention.

DETAILED DESCRIPTION OF THE PREFERRED EMBODIMENT(S)

Figure 1:
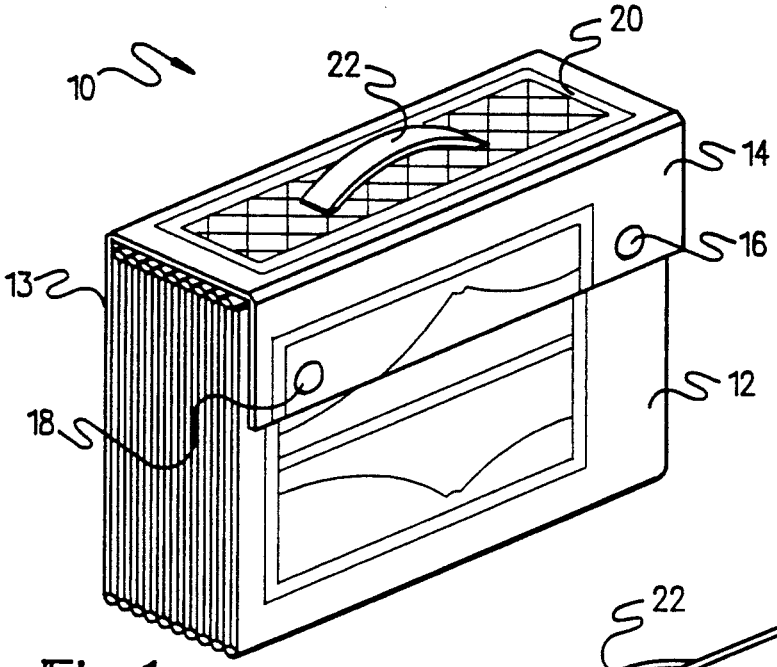
FIG. 1 is a perspective view illustrating the folding portable play enclosure for children according to the present invention in a collapsed orientation for storage and transportation.
Figure 2:
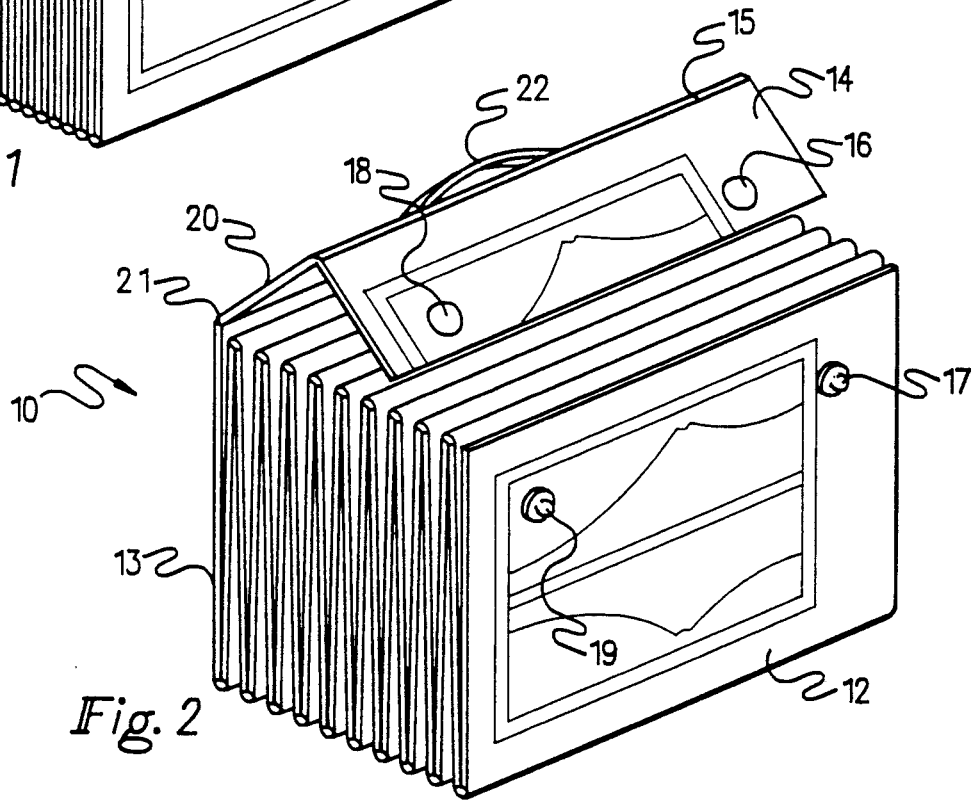
FIG. 2 is a perspective view illustrating the manner of opening and erecting the folding portable play enclosure for children. according to the present invention.
Figure 3:
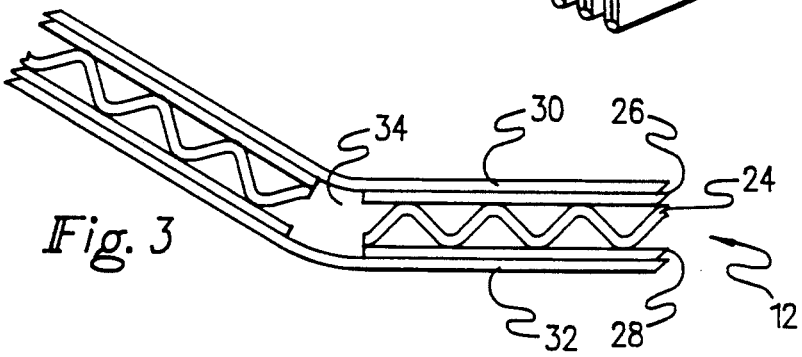
FIG. 3 is an end detail view illustrating the laminated vinyl and cardboard sandwich construction of the panels of the folding portable play enclosure for children according to the invention.

Referring now to the drawings, wherein like reference numerals designate corresponding structure throughout the views, and referring in particular to FIGS. 1 through 3, an improved folding portable play enclosure for children 10 according to a first preferred embodiment of the invention includes a series of substantially rectangular panels interconnected in a series in an accordion-fold manner by a plurality of flexible double folding joints. The series of panels, in the collapsed and partially collapsed orientations illustrated respectively in FIGS. 1 and 2, includes a first panel 12 and a last panel 13. A plurality of cooperating snap fasteners 16, 17, 18, and 19 provided on the first panel 12 and a front closure panel 14 selectively maintain the play enclosure 10 in the collapsed orientation illustrated in FIG. 1 for convenient transportation and storage.

As shown in FIG. 2, the front closure panel 14 is connected by a double folding flexible joint 15 to a top closure panel 20. The opposite end of the top closure panel 20 is connected by a flexible joint 21 to the upper edge of the last panel 13 in the series of interconnected panels forming the play enclosure 10. As can be appreciated from FIG. 1, the top closure panel 20 has a width dimensioned to span the thickness of the series of panels forming the play enclosure 10, when disposed in the collapsed orientation. Additionally, the front closure panel 14 and associated snap fastener 16 and 18 are dimensioned for alignment and conformance with the snap fasteners 17 and 19 provided on the first panel 12.

A loop-type handle 22, preferably formed from a plastic material, is secured substantially centrally on the top closure panel 20, as shown in FIG. 1, for facilitating the convenient transportation and storage of the enclosure 10 in the collapsed orientation.

FIG. 3 is a partial detail end view illustrating the construction of the panels, for example panel 12, forming the enclosure 10. Each panel includes a conventionally formed cardboard sheet possessing a substantially sinusoidal inner sheet 24 sandwiched between face cardboard sheets 26 and 28. The conventional corrugated cardboard sheet is in turn sandwiched between adhesively secured inner 30 and outer 32 flexible plastic layers. A preferred flexible plastic material is vinyl. The flexible double folding joints between adjacent panels are formed by the provision of a space 34 between the ends of each adjacent pair of corrugated cardboard sheets in the series. As can now be readily understood, the flexible nature of the vinyl material comprising layers 30 and 32 allows the adjacent panels to be alternately folded into a collapsed orientation in an accordion-fold manner, as illustrated in FIGS. 1 and 2.

Figure 4:
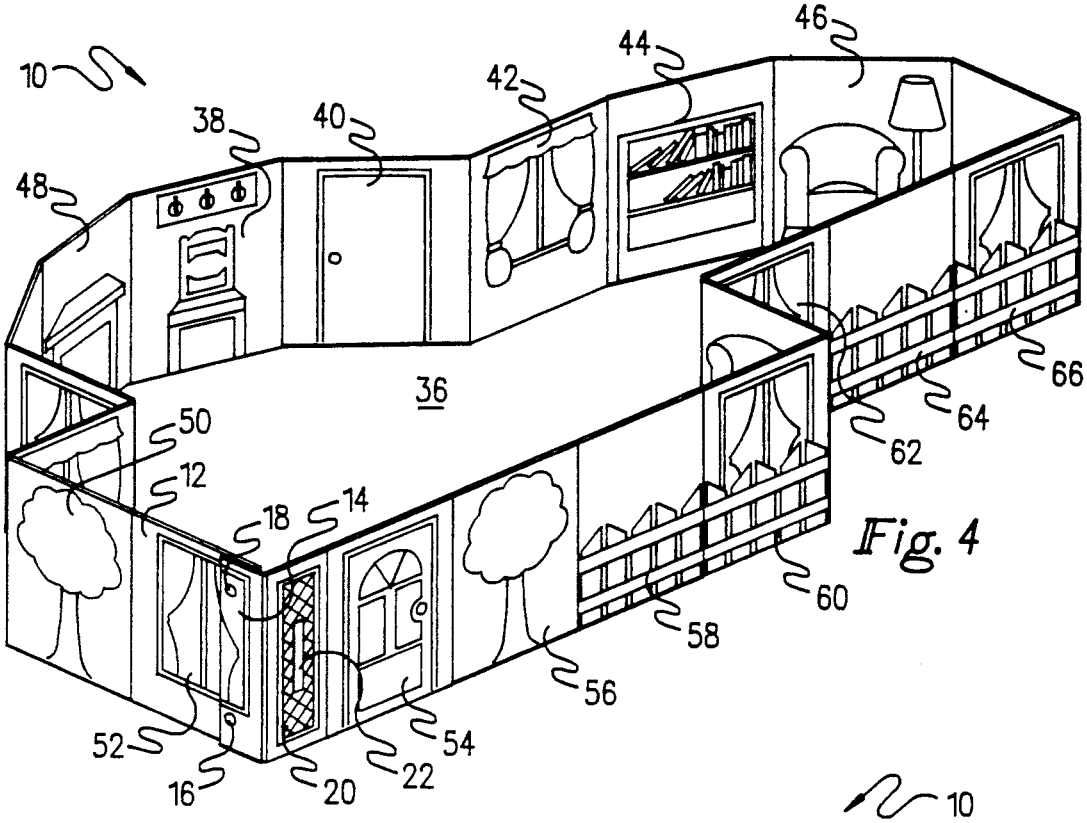
FIG. 4 is a perspective view illustrating the folding portable play enclosure for children according to the present invention in an erected orientation, forming an enclosed play space for children.
Figure 5:
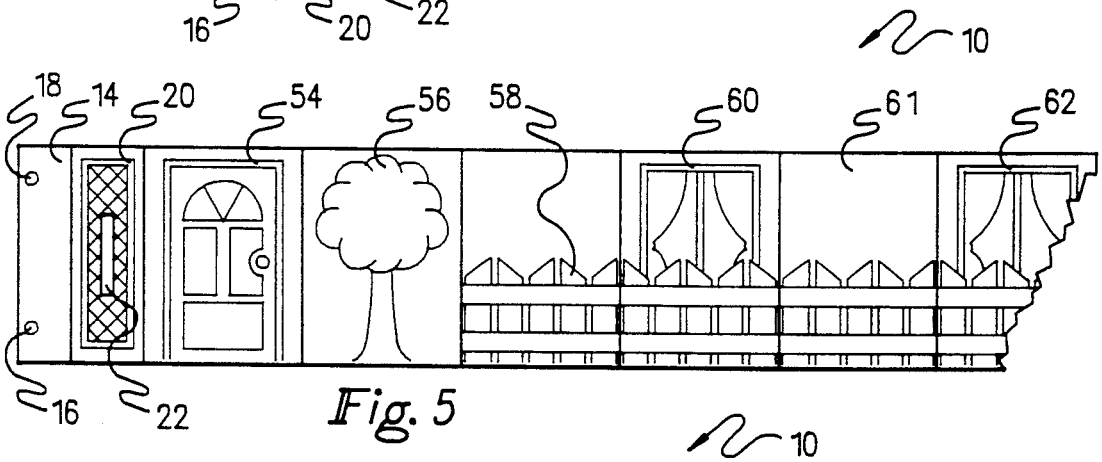
FIG. 5 is a side elevational view illustrating indicia on a first face of the panels forming the folding portable play enclosure for children of the present invention, simulating an exterior appearance of a home.
Figure 6:
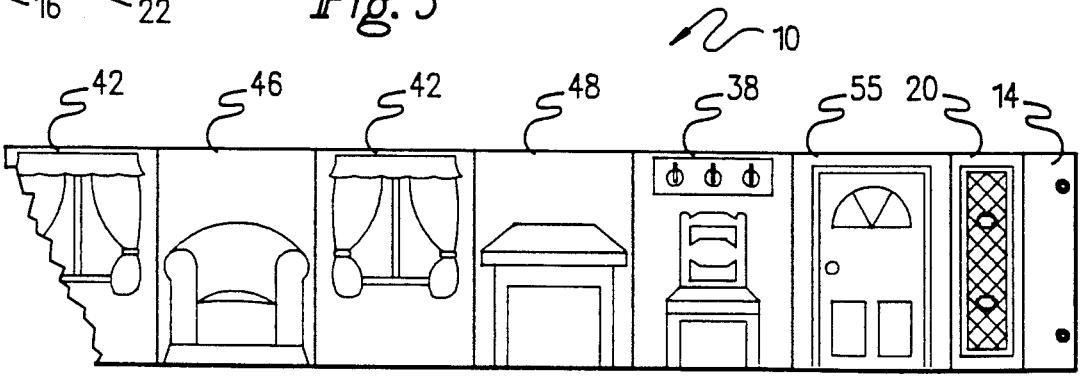
FIG. 6 is a side elevational view illustrating indicia on a second face of the panels forming the folding portable play enclosure for children of the present invention, simulating an interior appearance of a home.

With reference to FIGS. 4 through 6, the play enclosure 10, in the erect orientation shown in FIG. 4, simulates both the interior and exterior appearances of a typical residential dwelling. As shown in FIG. 4, the cooperating snap fasteners 16 and 18 (17 and 19 in FIG. 2) on the panels 14 and 12 allows a child to secure the series of interconnected panels in a closed orientation to simulate a house. In this context, the double folding flexible joints between adjacent panels allows a child to simulate realistically the operation of a conventional home door.

A variety of different indicia is preferably provided on both faces of each of the panels forming the enclosure 10, preferably by printing on the vinyl layers 30 and 32, (FIG. 3). With reference to FIGS. 4 and 5, the first indicia 50, 52, 54, 56, 58, 60, 61, 62, 64, and 66 includes respectively, simulations of a tree, an exterior window, an exterior door, a tree, a fence section, a fence section and exterior window, a fenced section, a fence and exterior window, a fence section, and a fence section and exterior window. Similarly, as depicted in FIGS. 4 and 6, second indicia on opposite faces of each of the panels simulates typical conventional components of a home such as a table 48, a chair 38, an interior door 40, an interior window 42, a bookshelf 44, and a chair and lamp 46. For added realism, an interior appearance of an entry door 55 (FIG. 6) is depicted adjacent the closure flap 14 such that a child may simulate entry and exit into the "home".

In the particularly preferred embodiment of the invention, the play enclosure includes 20-full sized panels, each having a height of about forty centimeters and a width of about thirty centimeters. The top closure panel 20 has a width of about ten centimeters to accommodate the thickness of the twenty panels in the collapsed orientation illustrated in FIG. 1. A play enclosure according to these preferred dimensions encloses approximately twenty square feet of play space within the interior 36 of the closed loop interconnected series of panels, as shown in FIG. 4. Due to its simplicity, the play enclosure 10 according to the present invention is suitable for use by children as young as two years. Due to the realistic simulation of an actual home, the attention span of children is held for as long as several hours, much more than with typical playhouse type toys. Further, the flexible panel construction allows the enclosure to be errected in a variety of different configurations, including various corners forming "nooks" and "rooms," thus providing a great deal of creative flexibility for children. Additionally, the device is extremely easy to assemble and erect, thus may be stored out of the way when not in use. The laminated sheet construction allows for inexpensive manufacture utilizing conventional web and sheet handling equipment, thus providing for an inexpensive sales price to the consuming public.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

WHAT IS CLAIMED IS:

1. A folding portable play enclosure for children, comprising:

a plurality of substantially rectangular panels connected in a series by folding joints in an accordion-fold manner;

first indicia on a first face of each of said panels simulating an exterior appearance of a home;

second indicia on a second face of each of said panels simulating an interior appearance of a home;

a first panel in said series including a first fastening means;

a last panel in said series connected by a flexible joint to a top closure panel;

said top closure panel having a width dimensioned to span a thickness of said series of panels in said collapsed orientation;

a front closure panel connected to a flexible joint to said top closure panel, opposite said last panel;

said front closure panel dimensioned to partially overlie said first panel and including second fastening means disposed for cooperation with said first fastening means for selectively securing said panels in a compact collapsed orientation for transportation and storage; and a handle secured to at least one of said panels and exposed for manual grasping in said collapsed orientation.

2. The folding portable play enclosure for children of claim 1, wherein said first and second fastening means comprise cooperating snap fasteners.

3. The folding portable play enclosure for children of claim 1, wherein each of said panels comprise cardboard sheets sandwiched between inner and outer flexible plastic layers.

4. The folding portable play enclosure for children of claim 3, wherein said plastic layers comprise vinyl.

5. The folding portable play enclosure for children of claim 3, wherein said first and second indicia are printed on said plastic layer.

6. The folding portable play enclosure for children of claim 3, wherein said folding joints are formed by spaces provided between ends of said pair of adjacent cardboard sheets.

7. The folding portable play enclosure for children of claim 1, wherein said first and second fastening means are disposed for alternatively securing end panels of said series to form an enclosed play space in an erected orientation of said enclosure.

8. The folding portable play enclosure for children of claim 1, wherein said first indicia is selected from the group of a tree, an exterior window, an exterior door, and a fence.

9. The folding portable play enclosure for children of claim 1, wherein said second indicia is selected from the group consisting of furniture, interior windows, interior doors, and bookshelves.

10. A folding portable play enclosure for children, comprising:

a plurality of substantially rectangular panels connected in a series by folding joints in an accordion-fold manner;

each of said panels comprising cardboard sheets sandwiched between inner and outer flexible plastic layers;

first indicia on a first face of each of said panels simulating an exterior appearance of a home;

second indicia on a second face of each of said panels simulating an interior appearance of a home;

fastening means for selectively securing said panels in a compact collapsed orientation for transportation and storage;

and a handle secured to at least one of said panels and exposed for manual grasping in said collapsed orientation.

11. The folding portable play enclosure for children of claim 10, wherein said fastening means comprises cooperating snap fasteners.

12. The folding portable play enclosure for children of claim 10, further comprising:

a first panel in said series including a first fastening means;

a last panel in said series connected by a flexible joint to a top closure panel;

said top closure panel having a width dimensioned to span a thickness of said series of panels in said collapsed orientation;

a front closure panel connected by a flexible joint to said top closure panel, opposite said last panel;

and said front closure panel dimensioned to partially overlie said first panel and including second fastening means disposed for cooperation with said first fastening means for securing said enclosure in said collapsed orientation.

13. The folding portable play enclosure for children of claim 10, wherein said plastic layers comprise vinyl.

14. The folding portable play enclosure for children of claim 10, wherein said first and second indicia are printed on said plastic layer.

15. The folding portable play enclosure for children of claim 10, wherein said folding joints are formed by spaces provided between ends of said pair of adjacent cardboard sheets.

16. The folding portable play enclosure for children of claim 10, wherein said fastening means is disposed for selectively securing end panels in said series to form an enclosed play space in an erected orientation of said enclosure.

17. The folding portable play enclosure for children of claim 10, wherein said first indicia is selected from the group of a tree, an exterior window, an exterior door, and a fence.

18. The folding portable play enclosure for children of claim 10, wherein said second indicia is selected from the group consisting of furniture, interior windows, interior doors, and bookshelves.

19. A folding portable play enclosure for children, comprising:

a plurality of substantially rectangular panels connected in a series by folding joints in an accordion-fold manner;

each of said panels comprise cardboard sheets sandwiched between inner and outer flexible plastic layers;

said folding joints formed by spaces provided between ends of said pair of adjacent cardboard sheets;

first indicia on a first face of each of said panels simulating an exterior appearance of a home;

second indicia on a second face of each of said panels simulating an interior appearance of a home;

a first panel in said series including said first fastening means;

a last panel in said series connected by a flexible joint to a top closure panel;

said top closure panel having a width dimensioned to span a thickness of said series of panels in said collapsed orientation;

a front closure panel connected by a flexible joint to said top closure panel, opposite said last panel;

said front closure panel dimensioned to partially overlie said first panel and including second fastening means disposed for cooperation with said first fastening means for selectively securing said panels in a compact collapsed orientation for transportation and storage and for alternatively selectively securing end panels of said series to form an enclosed play space in an erected orientation of said enclosure; and a handle secured to at least one of said panels and exposed for manual grasping in said collapsed orientation.

20. The folding portable play enclosure for children of claim 19, wherein:

said first indicia is selected from the group of a tree, an exterior window, an exterior door, and a fence; and said second indicia is selected from the group consisting of furniture, interior windows, interior doors, and bookshelves.

* * * * *